US008142231B2

(12) United States Patent
Tung et al.

(10) Patent No.: US 8,142,231 B2
(45) Date of Patent: Mar. 27, 2012

(54) CONNECTOR ASSEMBLY FEATURED WITH QUICK-RELEASE MECHANISM

(75) Inventors: Chang-Hsien Tung, Tu-Cheng (TW); Kuo-Chun Hsu, Santa Clara, CA (US); Wei-Chung Lin, Tu-Cheng (TW); Kai-Li Wang, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 38 days.

(21) Appl. No.: 12/840,310

(22) Filed: Jul. 21, 2010

(65) Prior Publication Data

US 2011/0159741 A1 Jun. 30, 2011

(30) Foreign Application Priority Data

Dec. 25, 2009 (TW) ..... 98144873

(51) Int. Cl.
*H01R 24/00* (2011.01)

(52) U.S. Cl. ..... 439/660

(58) Field of Classification Search ..... 439/660, 439/668, 669, 675, 700, 346, 701, 744, 188
See application file for complete search history.

(56) References Cited

U.S. PATENT DOCUMENTS

| | | | | |
|---|---|---|---|---|
| 6,382,999 | B1 * | 5/2002 | Mou et al. | 439/188 |
| 7,108,514 | B2 * | 9/2006 | Chen et al. | 439/63 |
| 7,278,863 | B1 * | 10/2007 | Chen et al. | 439/79 |
| 7,285,024 | B1 * | 10/2007 | Tai | 439/668 |
| 7,726,990 | B2 * | 6/2010 | Wang et al. | 439/188 |
| 2005/0048847 | A1 * | 3/2005 | Hsieh | 439/668 |
| 2010/0144213 | A1 * | 6/2010 | Lin et al. | 439/744 |

* cited by examiner

*Primary Examiner* — Edwin A. Leon
(74) *Attorney, Agent, or Firm* — Andrew C. Cheng; Wei Te Chung; Ming Chieh Chang

(57) ABSTRACT

An electrical connector includes an insulative housing and a first and second contact received in the housing. The housing defines a mating face, a rear face opposite to the mating face, and a supporting face disposed between the mating and rear faces. A mating cavity recesses from the mating face towards the supporting face and disposed therebetween, and a receiving groove recesses forwards from the rear face and runs through the supporting face to communicate with the mating cavity. The first contact is retained in the receiving groove with an elastic contacting porting running through the supporting face and projecting into the mating cavity. The second contact is retained in the housing and includes two opposite second contacting portions disposed at two opposite sides of the elastic contacting portion of the first contact. A mating connector can be rotated to disengage from the electrical connector.

10 Claims, 8 Drawing Sheets

CONNECTOR ASSEMBLY FEATURED WITH QUICK-RELEASE MECHANISM

CROSS-REFERENCE TO RELATED APPLICATIONS

This application is related to U.S. patent application Ser. No. 12/646,835, filed on Dec. 23, 2009 and entitled "CONNECTOR ASSEMBLY FEATURED HEAD-TO-HEAD MATING INTERCONNECTION AND QUICK-DISCONNECTION THEREFROM", which have the same assignee as the present invention.

BACKGROUND OF THE INVENTION

1. Field of the Invention

The present invention relates to a connector assembly, and more particularly to a connector assembly in which first and second connectors are head-to-head interconnected, while can be quickly disengaged from one another when the second connector is axially tilted with respect to the first connector.

2. Description of the Related Art

U.S. Pat. No. 6,382,999 issued to Mou et al. on May 7, 2002 discloses an electrical connector assembly including a socket connector and a plug connector mating with the socket connector. The socket connector includes a housing defining a mating cavity through a mating face and a plurality of contacts retained to the housing. The plurality of contacts includes a central contact which defines a contacting post projecting into the mating cavity and is further located adjacent to the mating face. The plug connector includes a contact having a U-shaped contacting portion which defines two separate contacting arms with a receiving room defined therebetween. When the plug connector is inserted into the mating cavity, the contacting post enters into the receiving room deeply and is gripped and retained by the contacting arms steadily, thereby facilitating an intended interconnection between the socket and plug connectors.

Since the contacting post is deeply inserted into the receiving room, the disengagement therefrom can only be done when the contacting post is in aligning with the socket and the pull-out force is within a certain angle with respect to an axis extending through the connectors. If the force used to pull the plug out of the socket is out of that range and is not properly aligned with the insertion direction of the plug, i.e. the pulling force is kind of normal to the plug, then the plug connector will be difficult to be disengaged therefrom. Therefore, a new design is required.

SUMMARY OF THE INVENTION

An object of the present invention is to provide an electrical connector from which a mating connector can be disconnected and dropped off rapidly even when the force is applied in a direction oblique to a mating direction.

In order to achieve the above-mentioned object, an electrical connector includes an insulative housing and a first and second contact received in the housing. The housing defines a mating face, a rear face opposite to the mating face, and a supporting face disposed between the mating and rear faces. A mating cavity recesses from the mating face towards the supporting face and disposed therebetween, and a receiving groove recesses forwards from the rear face and runs through the supporting face to communicate with the mating cavity. The first contact is retained in the receiving groove with an elastic contacting porting running through the supporting face and projecting into the mating cavity. The second contact is retained in the housing and includes two opposite second contacting portions disposed at two opposite sides of the elastic contacting portion of the first contact.

Other objects, advantages and novel features of the invention will become more apparent from the following detailed description of the present embodiment when taken in conjunction with the accompanying drawings.

DETAILED DESCRIPTION OF THE INVENTION

Figure 1:
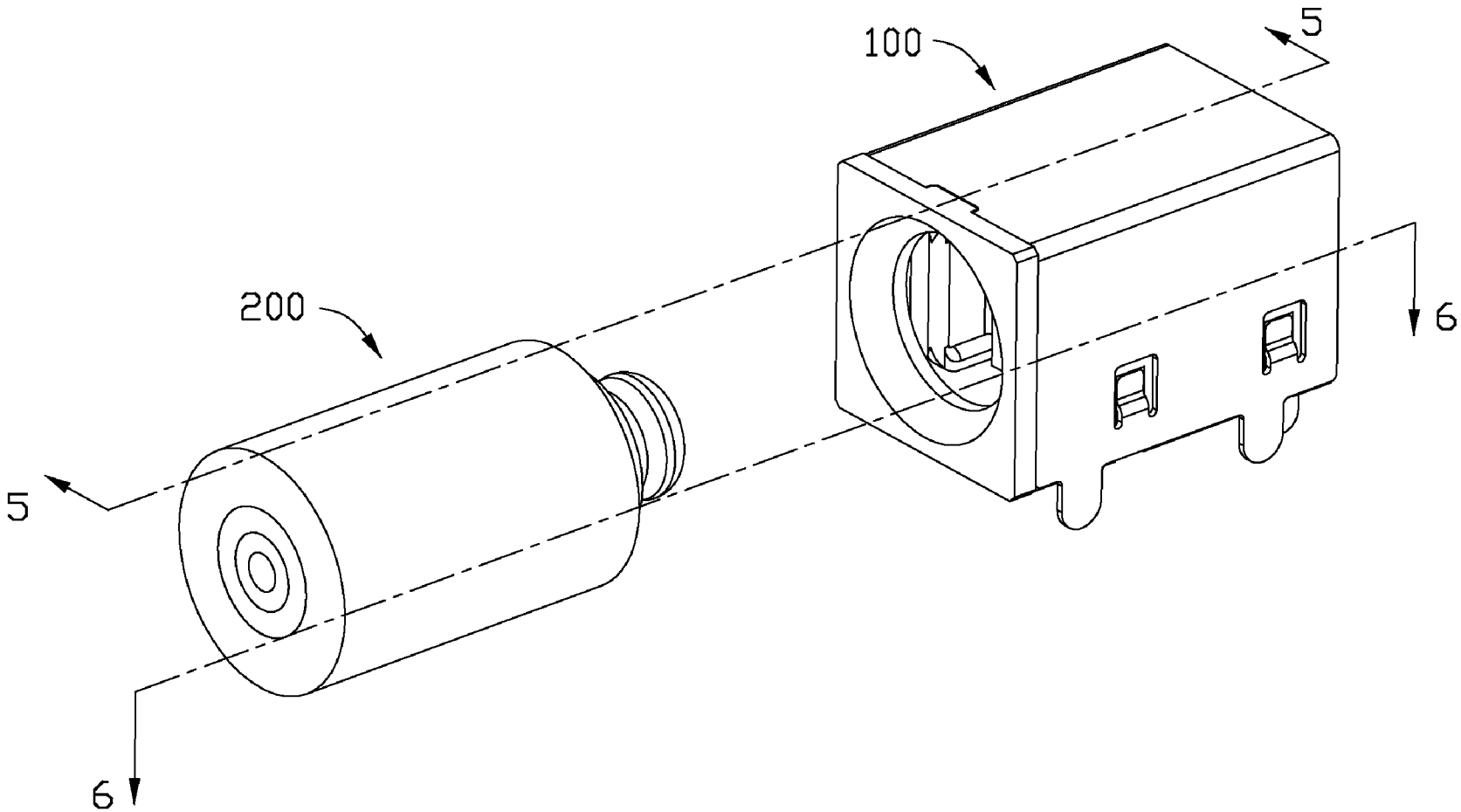
FIG. 1 is a perspective view of an electrical connector assembly in accordance with the present invention.

Reference will now be made to the drawing figures to describe the preferred embodiment of the present invention in detail.

Figure 2:
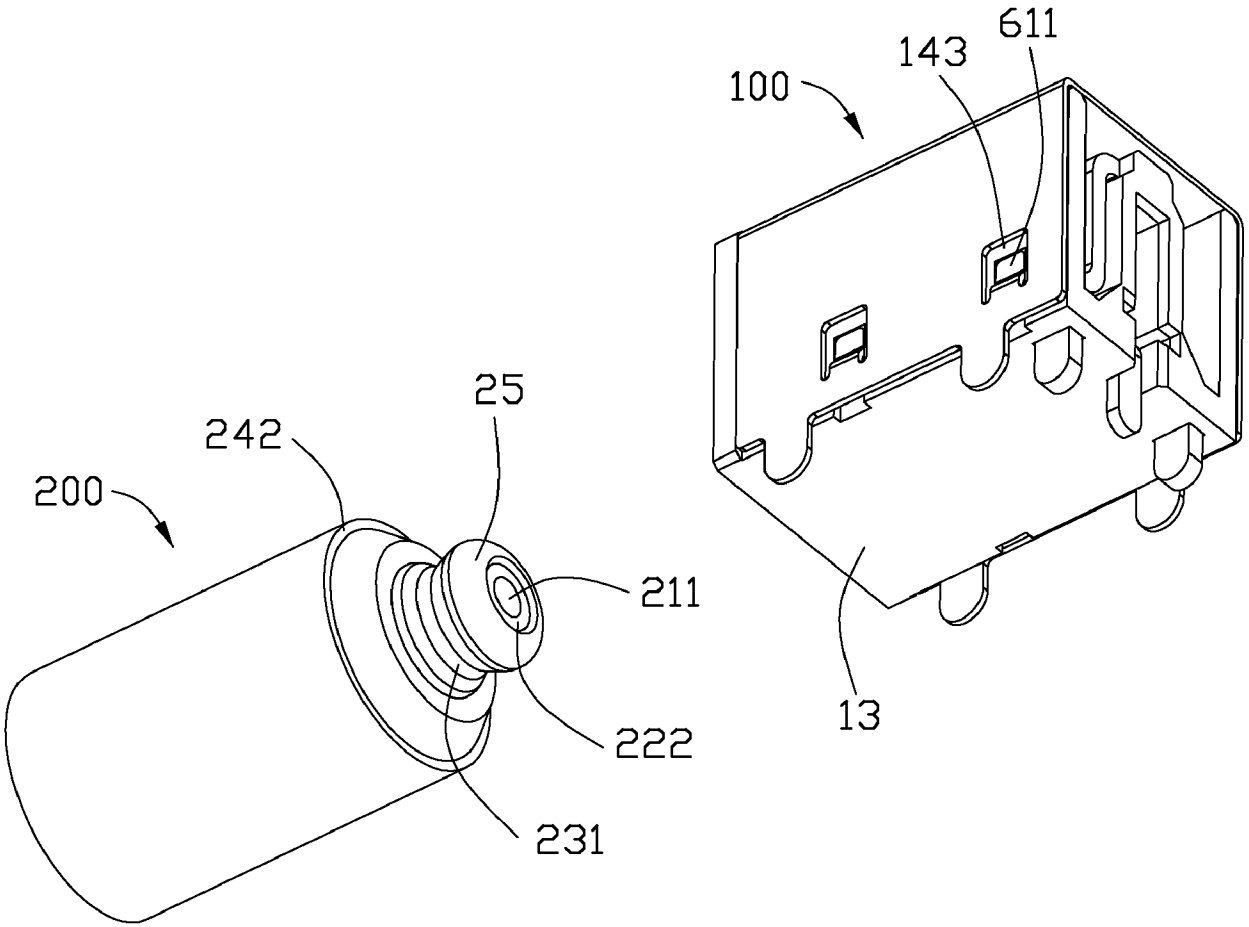
FIG. 2 is another perspective view of the electrical connector assembly shown in FIG. 1.

Referring to FIG. 1 and FIG. 2, an electrical connector assembly made in accordance with the present invention is provided. The electrical connector assembly includes a first (or socket) connector 100 and a second (or plug) connector 200 mating with the first connector.

Figure 3:
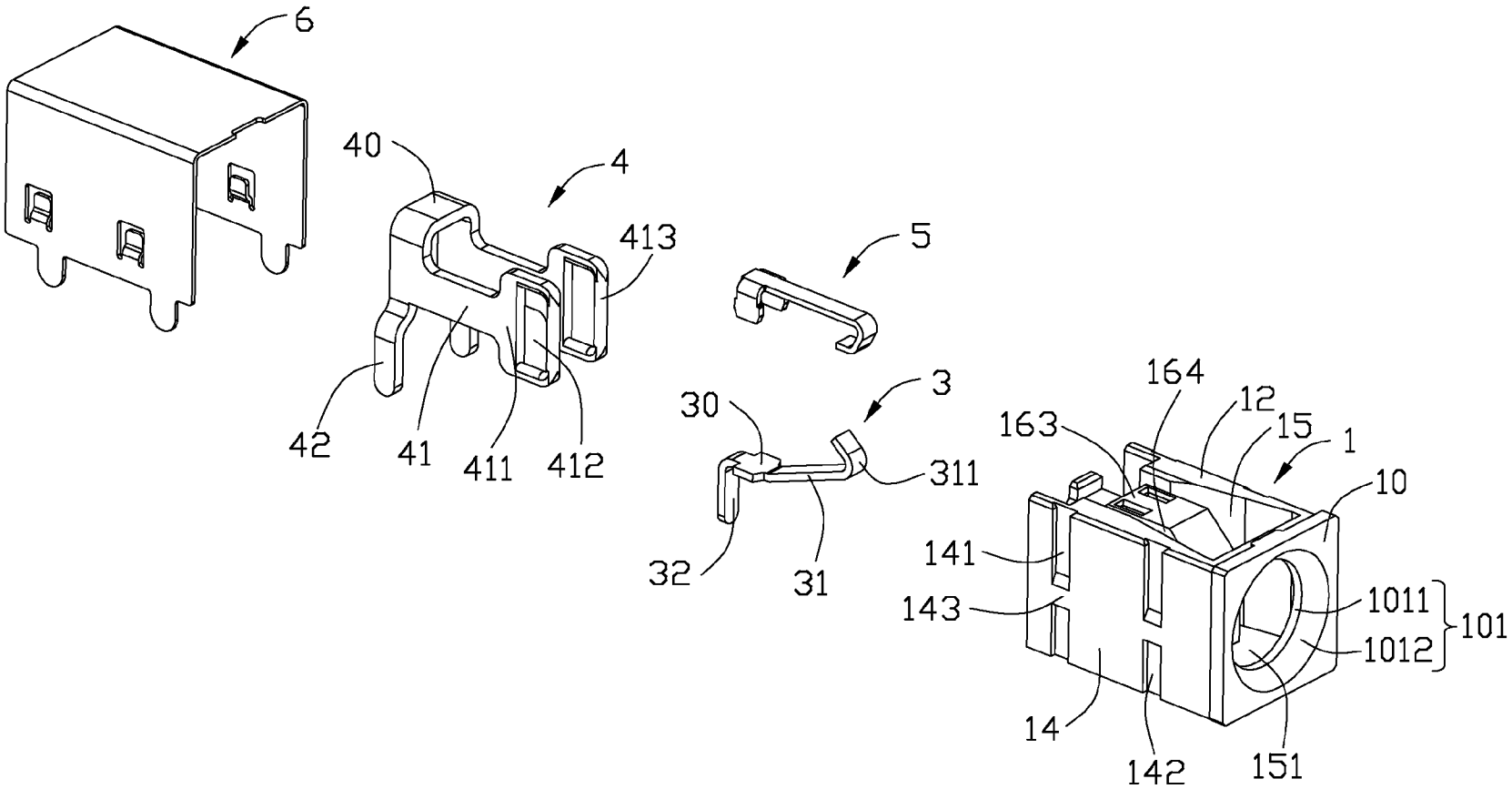
FIG. 3 is an exploded perspective view of a first connector shown in FIG. 1.
Figure 4:
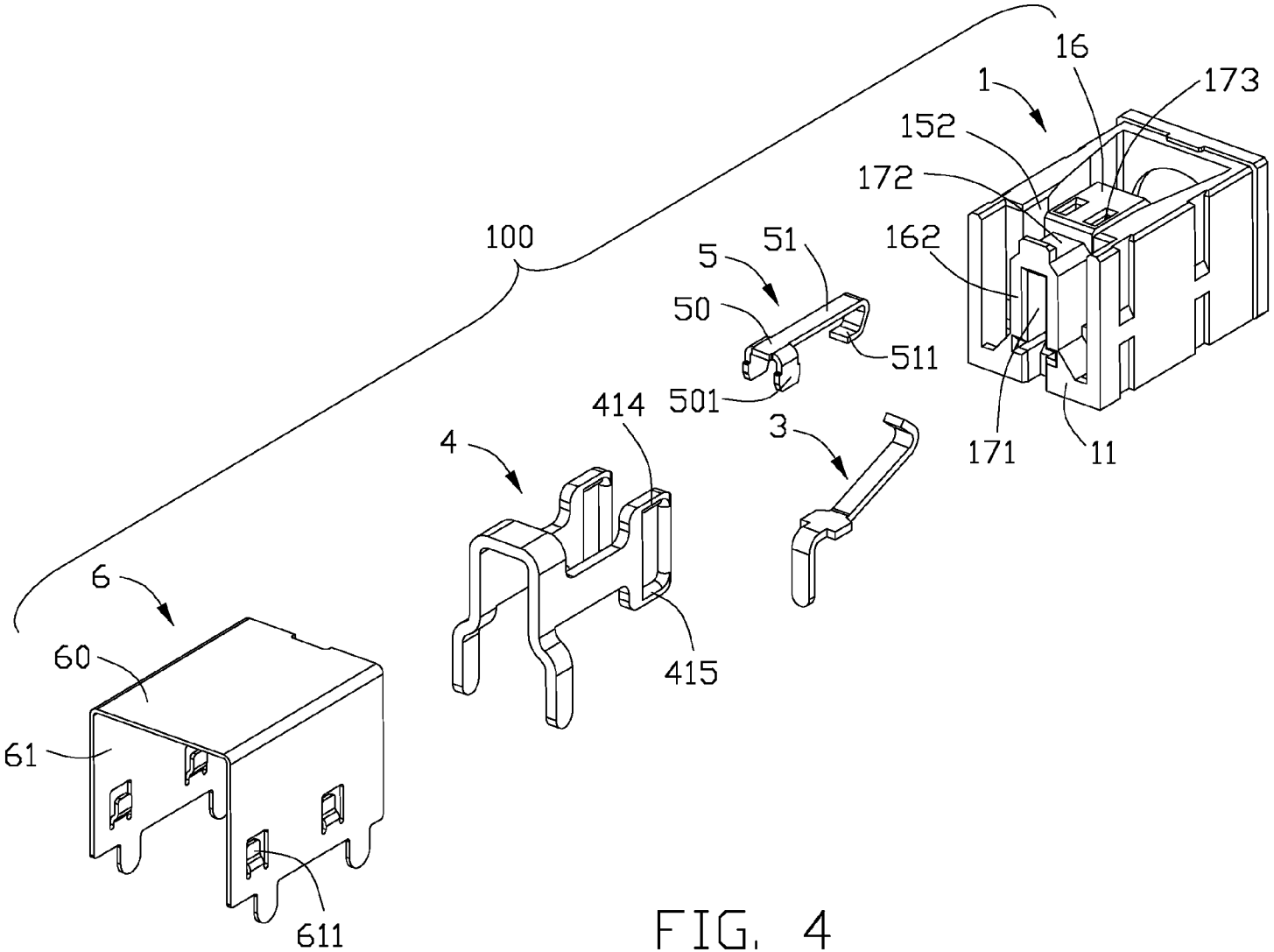
FIG. 4 is another exploded perspective view of the first connector shown in FIG. 3.

Referring to FIG. 2 to FIG. 4, the first connector 100 includes an insulative housing 1, a first and second contact 3, 4 retained in the housing, a retaining member 5 and a shell 6 surrounding the housing 1. The housing 1 of a rectangular configuration defines a front/mating face 10, a rear face 11 opposite to the mating face 10, a top wall 12 perpendicular to the mating face 10, a bottom wall 13 opposite to the top face and a pair of sidewalls 14 perpendicular to the mating face 10 and the bottom wall 13. A receiving room 15 opening upwards runs through the mating face 10 and the rear face 11. The receiving room 15 flares toward the mating face 10 and provides an opening 101 at a front wall of the housing 1, and the opening 101 defines a first columnar portion 1011 and a second portion 1012 extending gradually enlarging toward the mating face 10.

Referring to FIG. 2 to FIG. 5, the housing 1 provides an installing portion 16 projecting upwards into the receiving room 15 from the bottom wall 13 at a rear portion thereof, the installing portion 16 spaces from the sidewalls 14 and defines a front face 161, a rear face 162 disposed in a same plane as the rear face 11 of the housing 1, a top face 163 parallel to the top wall 12 and two opposite side faces 164 facing to the side walls 14 of the housing 1. The front face 161 of the installing portion 16 is spaced from the mating face 10 of the housing 1, and a mating cavity 151 for receiving the second connector 200 is provided between the mating face 10 and the front face 161. The front face 161 is defined as a supporting face of the housing 1, and the opening 101 provided in the front wall is defined as an opening of the mating cavity 151. The rear face 162 of the installing portion 16 is defined as a part of the rear face 11 of the housing 1. The side faces 164 each is spaced from the opposite sidewall 14 and a receiving slot 152 is provided therebetween. The housing 1 defines a first receiving groove 171 recessed forwards from the rear face 162 of the installing portion 16 and running through a middle portion of the supporting face 161 to communicate with the mating cavity 151. The installing portion 16 provides a U-shaped second receiving groove 172 recessed downwards from the top face 163 at a rear portion thereof. The diameter D of the first columnar portion 1011 is larger than the distance L between the mating face 10 of the housing 1 and the supporting face 161.

Referring to FIG. 2 to FIG. 5, the first contact 3 acts as a positive contact of the first connector 100. The first contact 3 defines a retaining portion 30, an elastic contacting arm 31 slantways extending forwards from the retaining portion 30 and a soldering portion 32. The first contact 3 defines an elastic contacting portion 311 bending from a front end of the elastic contacting arm 31. The first contact 3 is inserted into the housing 1 with the retaining portion 30 retained in the first receiving groove 171, and the elastic contacting arm 31 is movably received in the first receiving groove 171, and the elastic contacting portion 311 runs through the supporting face 161 and projects into the mating cavity 151.

The second contact 4 acts as a negative contact/grounding contact of the first connector 100. The second contact 4 defines an inverted U-shaped main body portion 40, a pair of clipping arms 41 oppositely extending forwards from two opposite sides of the main body portion 40, and a pair of soldering portions 42 each bending outwards and then extending downwards from a free end of the main body portion 40. The clipping arms 41 each defines a second contacting portion 411 disposed at a free end thereof, and the second contacting portions 411 each defines a window portion 412 thereof. The window portion 412 defines a front frame 413, an upper frame 414 and a lower frame 415 facing to the upper frame 414. The front frame 413 is of a columnar shape, and the upper and lower frames 414, 415 each define an arc-shaped inner faces. The second contact 4 is downwardly assembled to the housing 1 with the inverted U-shaped main body portion 40 climbing over the installing portion 16 and retained in the second receiving groove 172. The clipping arms 41 are retained in the receiving slots 152, and the second contacting portions 411 extends into the mating cavity 151 and are disposed at two opposite sides of the elastic contacting portion 311 of the first contact 3. The soldering portions 42 run through the bottom wall 13 of the housing and extend out of the housing 1.

The retaining member 5 defines a retaining portion 50 and an elastic latching arm 51 extending forwards from the retaining portion 50. The retaining member 5 is retained in the installing portion 16 by the latching legs 501 locking into the locking holes 173 recessed from the top face 163. A locking portion 511 bending from a front end of the latching arm 51 extends into the mating cavity 151 and further goes beyond the elastic contacting portion 311, and the locking portion 151 is disposed above the elastic contacting portion 311.

The shell 6 retained to the housing defines a top piece 60 covering on the top wall 12 of the housing 1, and a pair of side pieces 61 bending from two sides of the top piece 60 for covering the sidewalls 14 of the housing 1. The shell 6 is downwardly assembled to the housing 1, and the elastic pieces 611 punching from the side pieces 61 move along the guiding slots 141, climb over the blocking portion 143 and enter into the locking slot 142 to block with the blocking portion 143.

Figure 5:
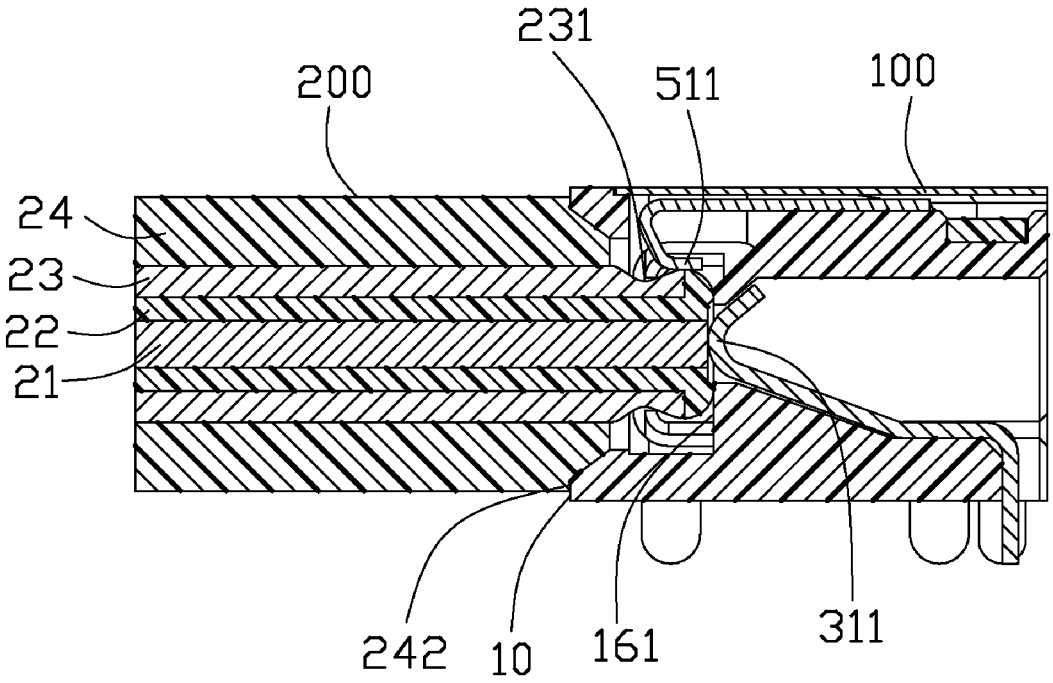
FIG. 5 is a cross sectional view taken along line 5-5 of FIG. 1.

Referring to FIG. 1, FIG. 2 and FIG. 5, the second connector 200 defines an insertion portion 25 for inserting into the mating cavity 151. The insertion portion 25 includes a columnar third contact 21, a first insulative portion 22 surrounding the outer surface of the third contact 21, and a forth contact 23 surrounding the outer surface of the first insulative portion 22. A second insulative portion 24 encloses a rear portion the second connector 200. A front face of the first insulative portion 22 recesses rearwards and provides a receiving portion 222 thereof, and the third contact 21 provides a third contacting portion 211 exposed on an inner face of the receiving portion 222. The forth contact 23 defines a slot 231 around the front end thereof.

Figure 6:
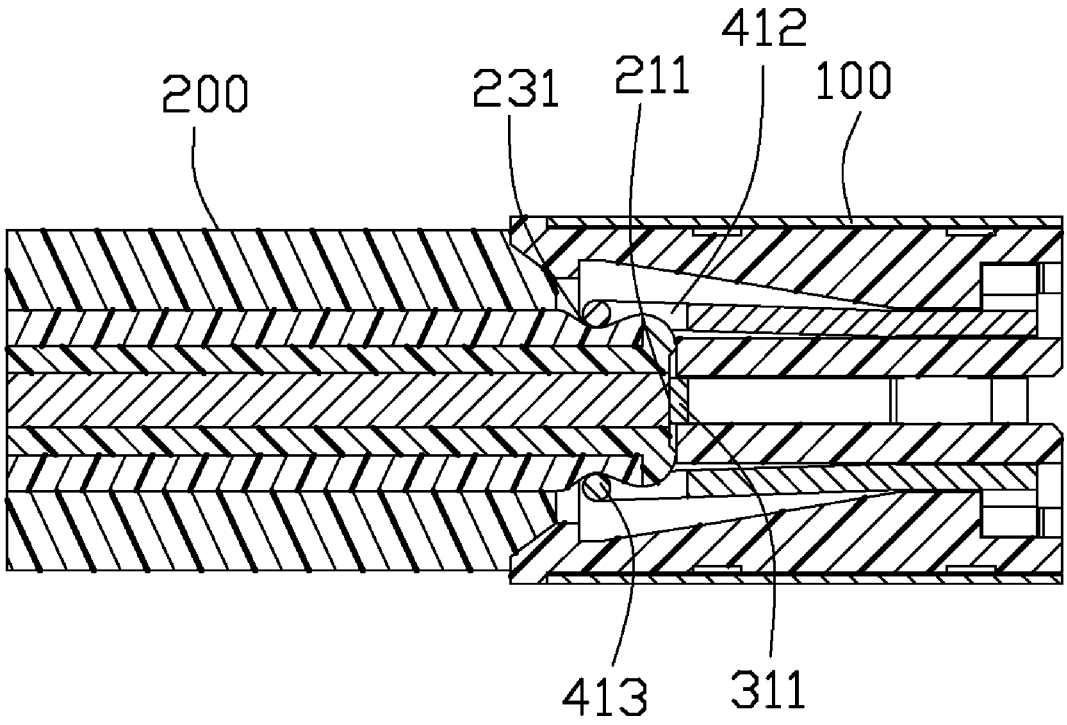
FIGS. 6-8 are cross sectional views taken along line 6-6 of FIG. 1, and the FIG. 6 shows the first and second connectors mated in a normal state, the FIG. 7 shows the second connector rotated under a force F, and the FIG. 8 shows the second connector rotated to disconnect with the first connector.

Referring to FIG. 5 and FIG. 6, while the first connector 100 mates with the second connector 200, the insertion portion 25 comes into the mating cavity 151 from a mating direction, the insertion portion 25 pushes the front frames 413 to make the clipping arms 41 moving outwards, and when the insertion portion 25 further enters into the widow portions 412 and abuts against the supporting face 161, the clipping arms 41 restored with the front frames 413 entering into the slot 231 to contact the forth contact 23 and clip the insertion portion 25 therebetween. Synchronously, the elastic contacting portion 311 of the first contact 3 enters into the receiving portion 222 and abuts against the third contacting portion 211; thereby a properly interconnection between the first and second connectors 100, 200 is provided. The retaining member 5 is disposed over the insertion portion 25 with the locking portion 511 blocking the insertion portion 25 downwardly, which can prevent the insertion portion 25 from dropping from the mating cavity 151 under the gravitation of the second connector 200, and the second connector 200 can be retained in the mating cavity 151 steadily. An outer cirque portion 242 of the second insulative portion 24 abuts against the mating face 10 of the housing 1.

Figure 7:
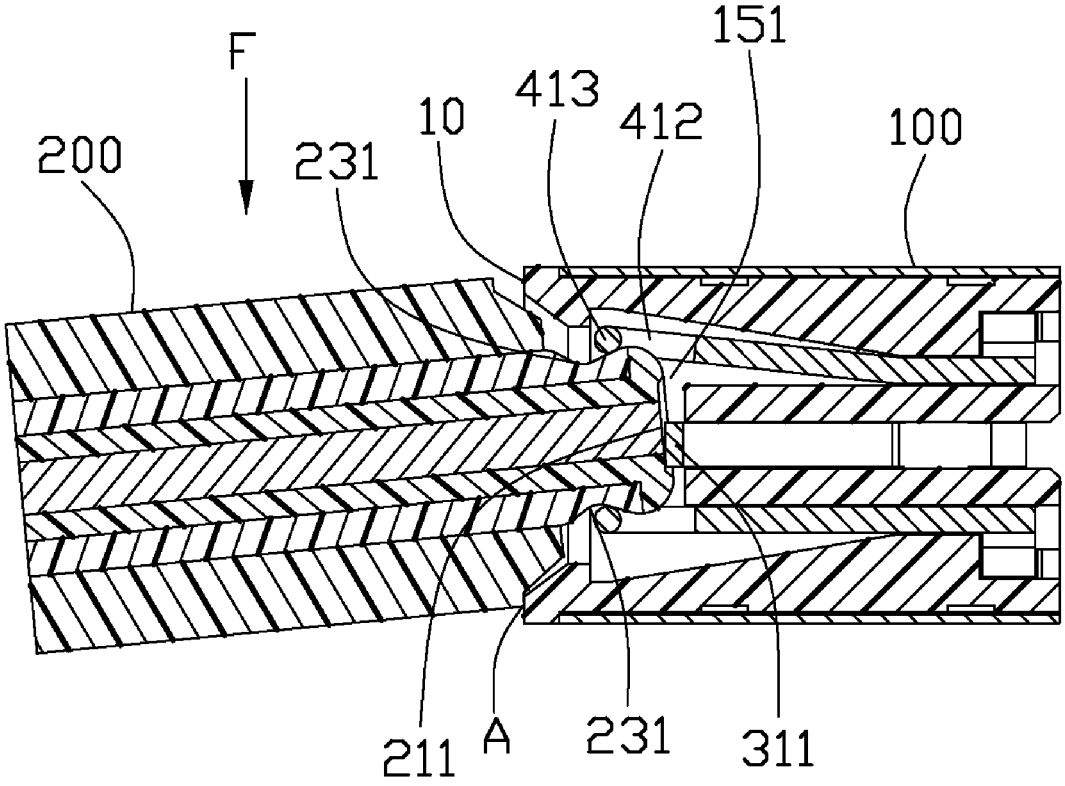
Figure 8:
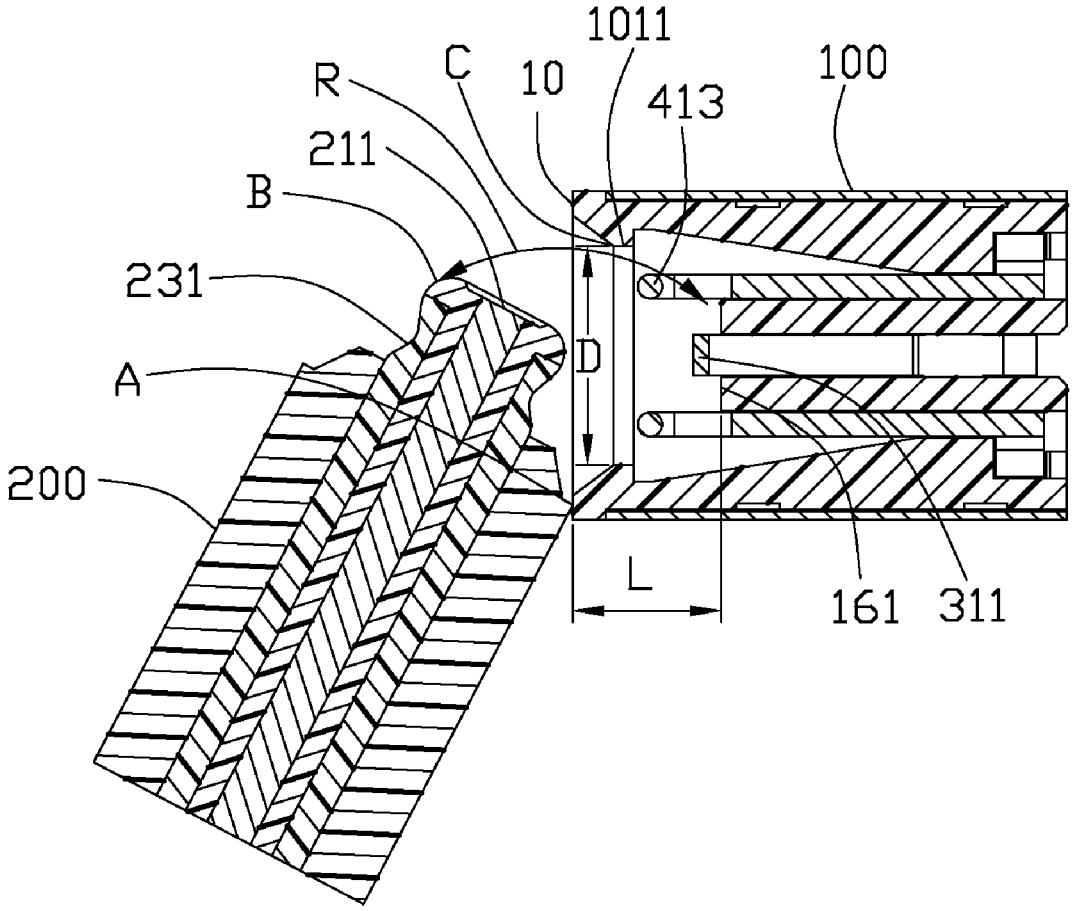

Referring to FIG. 6 to FIG. 8, the second connector 200 can be disconnected and dropped from the mating cavity 151 normally by being pulled outwards along a direction parallel to a mating direction. Moreover, when a cable terminated to the second connector 200 is tripped inadvertently, a force F which is along a direction oblique to the mating direction will be created, in this embodiment, the force F is defined as along a sideward direction normal to the mating direction. The second connector 200 rotates with the outer cirque portion 242 being supported by the mating face 10, and a pivot/lower point A is provided on the mating face 10 viewed from side view. The second connector 200 further rotates around the pivot/lower point A, and the front end of the insertion portion 25 pushes one of the front frames 413 of the clipping arm 41 to make the clipping arm 41 deformed until the front frame 413 moves out of the slot 231, and the elastic contacting portion 311 disconnect with the third contacting portion 211, and the second connector 200 is rotated to disengage from the first connector 100. Referring to FIG. 8, the shortest distance from the pivot/lower point A to the inner face of the first columnar portion 1011, such as the distance between the pivot/lower point A and an upper point C viewed from side view, is defined to be larger than the longest distance from the pivot/lower point A to the insertion portion 25, such as the distance between the pivot/lower point A and point B, which can prevent the insertion portion 25 from engaging with the opening 101 of the mating cavity 151 while the second connector 200 rotating, and ensure that the second connector 200 rotates out of the mating cavity 151 to disengage from the first connector 100 easily under the force F. The dimension of the insertion portion 25 can be dimensioned to a certain range that the longest distance from the pivot/lower point A to the insertion portion 25 (the distance between the lower point A and the point B, shown in FIG. 8) is not lager than the shortest distance from the pivot/lower point A to the inner face of the first columnar portion 1011 (the distance between the lower point A and the upper point C, shown in FIG. 8), so that the point B moves along the trajectory R while the second connector 200 rotating centered on the pivot/lower point A, and the insertion portion 25 will not be blocked by the upper point C.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising: an insulative housing defining a mating face, a rear face opposite to the mating face, and a supporting face disposed between the mating and rear faces, a mating cavity recessed from the mating face towards the supporting face and disposed therebetween, and a receiving groove recessed forwards from the rear face and running through the supporting face to communicate with the mating cavity; a first contact retained in the receiving groove with an elastic contacting porting running through the supporting face and projecting into the mating cavity; and a second contact retained in the housing and including two opposite second contacting portions disposed at two opposite sides of the elastic contacting portion of the first contact; wherein the second contact defines a pair of clipping arms disposed in the mating cavity, and the second contacting portions each is disposed at a free end of the clipping arm; wherein the second contacting portions each defines a window portion thereof, and the window portion defines a front frame; wherein the second contact defines an inverted U-shaped main body portion climbing over the housing, and the clipping arms respectively extends from two opposite sides of the main body portion; further comprising a retaining member disposed between the two clipping arms.

2. The electrical connector as described in claim 1, wherein the mating cavity provides an opening at a front wall of the housing, and the opening defines a columnar portion with a diameter larger than the distance between the mating face and the supporting face.

3. The electrical connector as described in claim 1, wherein the elastic contacting portion of the first contact runs through a central portion of the supporting face.

4. The electrical connector as described in claim 1, wherein the first contact defines a retaining portion retained in the receiving groove, an elastic contacting arm slantways extending from the retaining portion and a soldering portion extending out of the housing, and the elastic contacting portion of the first contact is bending from a front end of the elastic contacting arm.

5. The electrical connector as described in claim 1, wherein the first contact acts as a positive contact, and the second contact acts as a grounding/negative contact.

6. An electrical connector assembly comprising:

a first connector including:

a first insulative housing defining an essentially circular hole extending inward from a first front mating face of the first insulative housing;

at least one contact being located in a centerline of said circular hole;

a second connector including:

a second insulative housing defining a round columnar protrusion forwardly extending from a second front mating face of the second insulative housing and adapted to be inserted into the circular hole, said round columnar protrusion being equipped with a narrowed waist region;

at least one contact being located in a centerline of said round columnar protrusion; and at least a pair of metallic spring pieces disposed in the first housing and oppositely diametrically located around the front portion of the circular hole under condition that a distance between said pair of metallic spring pieces is essentially slightly smaller than a diameter of said round columnar protrusion whereby the round columnar protrusion is allowed to be inserted into the circular hole in a tilted manner wherein the round columnar protrusion abuts, at an abutment point, against one of said pair of metallic spring pieces obliquely with regard to an axial direction of the circular hole and rotated abut said abutment point toward the other of said pair of metallic spring pieces until aligned in said axial direction with regard to the centerline of the circular hole for mating, or in a reversed procedure for un-mating.

7. The electrical connector assembly as claimed in claim 6, further including a first ring like chamfered structure formed in a front portion of the circular hole proximate the first front mating face, and a second ring like chamfered structure formed on the second front mating face surrounding the round columnar protrusion, wherein said first ring like chamfered structure intimately confronts the second ring like chamfered structure in a front-to-back direction after the first connector and the second connector are mated with each other.

8. The electrical connector assembly as claimed in 6, wherein at least one of said pair of metallic pieces further performs a contact function.

9. The electrical connector assembly as claimed in claim 6, wherein the first connector further includes another pair of metallic pieces around the circular hole to cooperate with said pair of metallic pieces to form a cross like configuration in a viewpoint along a front-to-back direction.

10. The electrical connector assembly as claimed in claim 6, wherein said pair of metallic pieces are unified together as one piece to not only perform a contact function but also be equipped with a locking structure to cooperate with the narrowed waist region to lock the inserted round columnar protrusion when mated.

* * * * *